US008770717B2

(12) United States Patent
Naruse et al.

(10) Patent No.: US 8,770,717 B2
(45) Date of Patent: Jul. 8, 2014

(54) IMAGE FORMING APPARATUS INCLUDING CARRIAGE THAT MOUNTS IMAGE FORMING UNIT

(75) Inventors: Shinichiro Naruse, Kanagawa (JP); Takayuki Niihara, Kanagawa (JP); Soichi Saiga, Tokyo (JP); Kenji Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 13/213,352

(22) Filed: Aug. 19, 2011

(65) Prior Publication Data

US 2012/0062649 A1 Mar. 15, 2012

(30) Foreign Application Priority Data

Sep. 9, 2010 (JP) ..... 2010-201738
May 27, 2011 (JP) ..... 2011-119389

(51) Int. Cl.
*B41J 2/165* (2006.01)

(52) U.S. Cl.
USPC ..... 347/37

(58) Field of Classification Search
None
See application file for complete search history.

(56) References Cited

U.S. PATENT DOCUMENTS

| | | | | |
|---|---|---|---|---|
| 5,966,147 | A * | 10/1999 | Matsui | 347/37 |
| 2004/0065162 | A1 * | 4/2004 | Iida | 74/89.2 |
| 2009/0136254 | A1 | 5/2009 | Niihara et al. | |
| 2010/0231643 | A1 | 9/2010 | Saiga et al. | |

FOREIGN PATENT DOCUMENTS

| | | |
|---|---|---|
| JP | 2002-168298 | 6/2002 |
| JP | 3787510 | 3/2006 |
| JP | 2007-152605 | 6/2007 |

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

An image forming apparatus includes a carriage, an image forming unit, a driving pulley, a driven pulley, a driving source, an open-ended carriage drawing member, and a mount. The drawing member is extended between the pulleys and having end portions mounted to the carriage. Each end portion has a surface including an indented area. The mount is disposed on the carriage and having first engagement portions and second engagement portions. Each first engagement portion has at least one indented area to engage the indented area of the drawing member. Each second engagement portion is connected to a corresponding first engagement portion in an orientation to be folded back relative to the corresponding first engagement portion. The end portions are mounted to the mount in a state in which the surface having the indented area is directed to a portion folded back along a corresponding second engagement portion.

12 Claims, 7 Drawing Sheets

IMAGE FORMING APPARATUS INCLUDING CARRIAGE THAT MOUNTS IMAGE FORMING UNIT

CROSS-REFERENCE TO RELATED APPLICATIONS

This patent application is based on and claims priority pursuant to 35 U.S.C. §119 to Japanese Patent Application Nos. 2010-201738, filed on Sep. 9, 2010 and 2011-119389, filed on May 27, 2011 in the Japan Patent Office, each of which is hereby incorporated herein by reference in its entirety.

TECHNICAL FIELD

This disclosure relates to an image forming apparatus, and more specifically to an image forming apparatus including a carriage that mounts an image forming unit.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink. During image formation, such liquid-ejection-type image forming apparatuses eject droplets of ink or other liquid from the recording head onto a recording medium to form a desired image.

As one sub type of such liquid-ejection-type image forming apparatus, a serial-type image forming apparatus is known that has a carriage mounting the recording head (liquid ejection head) serving as an image forming unit. Such a serial-type image forming apparatus forms an image by ejecting droplets from the recording head while moving the carriage mounting the recording head in a main scanning direction and intermittently feeding the recording medium in a sub-scanning direction perpendicular to the main scanning direction. Although the image forming unit is described below as the liquid ejection head, the image forming unit is not limited to the liquid ejection head and may be any other type of image forming unit.

Such a serial-type image forming apparatus typically has a main scanning mechanism (carriage scanning mechanism) to move the carriage mounting the image forming unit for scanning in the main scanning direction. The main scanning mechanism includes a driving source, a driving pulley mounted to the driving source, a driven pulley driven by rotation of the driving pulley, and an endless timing belt extended between the driving pulley and the driven pulley and serving as a carriage drawing member to draw the carriage partially fixed on the timing belt.

For example, for an image forming apparatus capable of forming images on large widths of recording media, a long-size timing belt is used as the drawing member and the carriage moves a relatively long distance during main scanning. Because a long-size endless belt compatible with image formation on large-width media costs much, it is conceivable to use an open-ended belt (i.e., belt having ends) instead of the endless belt.

However, as the main scanning distance of the carriage increases, the tension applied to the belt need be increased to stably perform the main scanning of the carriage. As a result, as the tension applied to the belt increases, end portions of the open-ended belt need be more firmly set to the carriage. In addition, the number of teeth of the belt is determined by the distance between the driving source (driving motor) and the driven pulley, and the tension of the belt is determined by the number of teeth. If the mount position of the belt to the carriage is shifted in installation, the number of teeth of the belt is changed, thus hampering application of a desired tension to the belt.

BRIEF SUMMARY

In an aspect of this disclosure, there is provided an image forming apparatus including a carriage, an image forming unit, a driving pulley, a driven pulley, a driving source, an open-ended carriage drawing member, and a mount. The carriage is movably supported to move reciprocally in a main scanning direction. The image forming unit is mounted on the carriage to form an image. The driving pulley is disposed at a first end in the main scanning direction. The driven pulley is disposed at a second end opposite the first end in the main scanning direction. The driving source is operatively connected to the driving pulley to rotate the driving pulley. The open-ended carriage drawing member is extended between the driving pulley and the driven pulley and having end portions mounted to the carriage, each of the end portions having a surface at least partially including an indented area. The mount is disposed on the carriage to mount the end portions of the drawing member and having first engagement portions and second engagement portions. Each of the first engagement portions has at least one indented area to engage the indented area of a corresponding one of the end portions of the drawing member. Each of the second engagement portions is connected to a corresponding one of the first engagement portions in an orientation to be folded back relative to the corresponding first engagement portion. The end portions of the drawing member are mounted to the mount of the carriage in a state in which the surface of each of the end portions having the indented area to engage a corresponding one of the first engagement portions is directed to a fold-back portion of each of the end portions folded back along a corresponding one of the second engagement portions relative to the corresponding one of the first engagement portions.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
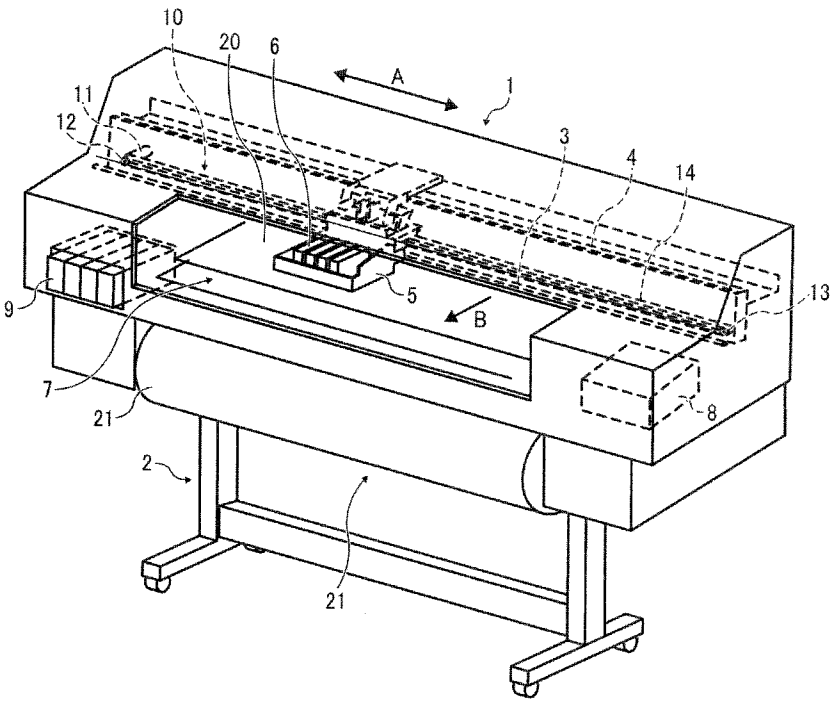
FIG. 1 is a perspective view of an inkjet recording apparatus as an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In this disclosure, the term "image forming apparatus" of liquid ejection type refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as recording liquid, fixing solution, liquid, and resin. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image.

Referring now to the drawings, wherein like reference numerals designate identical or corresponding parts throughout the several views, exemplary embodiments of the present disclosure are described below.

Figure 2:
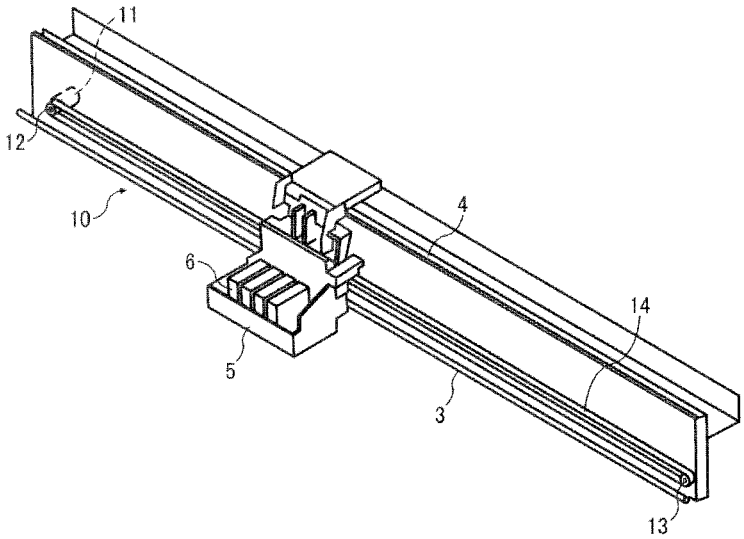
FIG. 2 is a perspective view of a carriage scanning mechanism of the inkjet recording apparatus illustrated in FIG. 1.

First, an inkjet recording apparatus is described as an image forming apparatus according to an exemplary embodiment of this disclosure with reference to FIGS. 1 and 2.

FIG. 1 is a perspective view of an entire configuration of the inkjet recording apparatus. FIG. 2 is a perspective view of a carriage scanning mechanism of the inkjet recording apparatus. In FIG. 1, the inkjet recording apparatus is a serial-type inkjet recording apparatus and has a main unit 1 and a support stand 2 to support the main unit 1.

The main unit 1 includes a guide rod 3 and a guide stay 4 that are extended between side plates. A carriage 5 is supported with the guide rod 3 and the guide stay 4 so as to be slidable along a main scanning direction indicated by an arrow A in FIG. 1. In other words, the guide rod 3 serves as a carriage guide member to guide movement of the carriage 5 along the main scanning direction, and the guide stay 4 serves as a support member to support the guide rod 3.

On the carriage 5 are mounded recording heads 6 serving as liquid-ejection-type image forming unit for ejecting ink droplets of, for example, black (K), yellow (Y), magenta (M), and cyan (C). The recording heads 6 are integrally provided with head tanks that supply inks to the recording heads. Although the image forming unit is described as liquid ejection head in this exemplary embodiment, the image forming unit is not limited to the liquid ejection head and may be any other type of image forming unit.

A main scanning unit 10 for moving the carriage 5 for scanning includes a driving motor 11 serving as a driving source disposed at one end in the main scanning direction, a driving pulley 12 rotated by the driving motor 11, a driven pulley 13 disposed at the opposite end in the main scanning direction, and a timing belt 14 serving as an open-ended carriage drawing member extended between the driving pulley 12 and the driven pulley 13. A tension spring urges the driven pulley 13 outward (in a direction to move away from the driving pulley 12) to apply tension to the timing belt 14.

In a recording area of a main scanning region of the carriage 5, a suction conveyance unit 7 intermittently conveys a sheet 20 in a direction (sub-scanning direction or sheet conveyance direction) indicated by an arrow B in FIG. 1.

At one end of the main scanning region is disposed a maintenance-and-recovery unit 8 to maintain and recover good conditions of the recording heads 6. In addition, at an area outside the main scanning region of the carriage or at the opposite end of the main scan region, main cartridges 9 serving as main tanks are removably mounted to the main unit 1 to store color inks supplied to the head tanks of the recording heads 6.

In FIG. 1, a roll sheet 20 (hereinafter, "sheet 20") is set on a sheet feeder 21. Alternatively, a roll sheet of a different width can be set on the sheet feeder 21. The sheet 20 fed from the sheet feeder 21 is conveyed with a conveyance device from a rear side to a front side of the apparatus to reach the recording area. While moving the carriage 5 in the main scanning direction and intermittently feeding the sheet 20, the inkjet recording apparatus ejects droplets from the recording heads 6 in accordance with image information to form a desired image on the sheet 20. After image formation, the sheet 20 is cut at a desired length and discharged to a discharge tray at the front side of the inkjet recording apparatus.

Next, an inkjet recording apparatus according to a first exemplary embodiment is described with reference to FIGS. 3 to 5.

Figure 3:
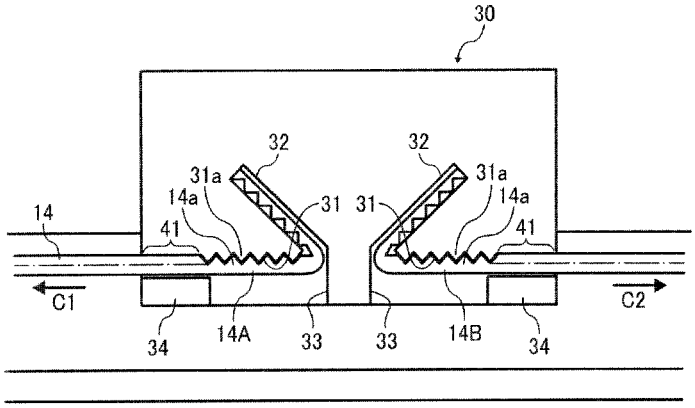
FIG. 3 is a front view of a belt mount of a carriage in a first exemplary embodiment in a state in which a timing belt is mounted to the belt mount.
Figure 4:
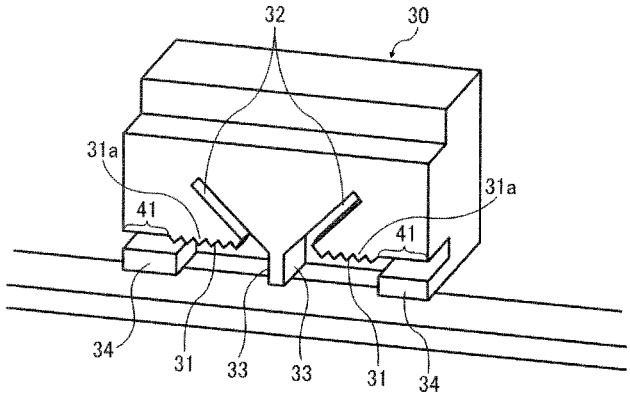
FIG. 4 is a perspective view of the belt mount of the carriage of FIG. 3.

FIG. 3 is a front view of a belt mount of a carriage in the first exemplary embodiment in a state in which the timing belt is mounted on the belt mount of the carriage. FIG. 4 is a perspective view of the belt mount of the carriage illustrated in FIG. 3. FIG. 5 is a front view of the belt mount of the carriage illustrated in FIG. 3.

On the back face of the carriage 5 (opposite the front face in which the recording heads 6 are disposed) is disposed a belt mount 30 serving as a drawing-member mount unit on which end portions 14A and 14B of the open-ended timing belt 14 serving as the open-ended carriage drawing member are mounted.

The belt mount 30 has first engagement portions 31 with indented areas 31*a* to engage indented areas 14*a* of the timing belt 14 and second engagement portions 32 oriented so that the direction in which each of the second engagement portions 32 extends intersects the direction in which the corresponding one of the first engagement portions 31 extends. For example, in FIG. 3, the first engagement portions 31 are formed along the main scanning direction, and the second engagement portions 32 are formed so as to sharply fold back relative to the main scanning direction (the direction in which the first engagement portions 31 extend).

The second engagement portions 32 have grooves to engage the timing belt 14. The second engagement portions 32 have a length L (see FIG. 5) of an integral multiple of an indentation pitch of the indented areas 14*a* of the timing belt 14. In other words, because the open ends of the timing belt 14 are cut at the concave portions, by setting the length L of the second engagement portions 32 to an integral multiple of the indentation pitch of indented areas 14*a*, the number of teeth of the timing belt 14 relative to the distance between the driving source (driving motor 11) and the driven pulley 13 can be fixed at a certain number, thus obtaining desired belt tension.

Unless the direction in which each of the second engagement portions 32 extends is on the same line as the direction in which the corresponding one of the first engagement portions 31 extends, the first engagement portions 31 may also be oriented at a desired angle relative to the main scanning direction.

Guide portions 33 are disposed between the first engagement portions 31 and the second engagement portions 32 to guide the timing belt 14 from the second engagement portions 32 to the first engagement portions 31. A portion between the guide portions 33 serves as a partition to divide the end portions 14A and 14B of the timing belt 14.

Figure 5:
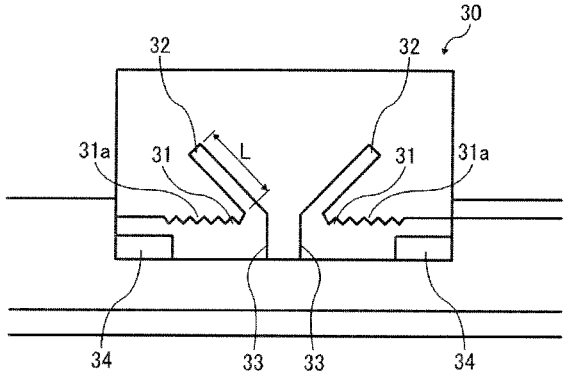
FIG. 5 is a front view of the belt mount of the carriage of FIG. 3.

As illustrated in FIG. 5, at an entry portion 41 of each first engagement portion 31 (opposite the portion between the guide portions 33) is disposed an engagement assist portion 34 to restrict movement of the timing belt 14 in a direction to move away from the indented area 31*a* of the first engagement portion 31.

For such a configuration, as illustrated in FIG. 3, the end portions 14A and 14B of the timing belt 14 are engaged with the first engagement portions 31 and the second engagement portions 32, and the indented areas 14*a* of the timing belt 14 are engaged with the indented areas 31*a* of the first engagement portions 31. Thus, the timing belt 14 is mounted on the belt mount 30. At this time, each of the end portions 14A and 14B of the timing belt 14 is mounted to the belt mount 30 in a state in which a surface having the indented area 14*a* is directed to a fold-back portion of the timing belt 14 folded back at the second engagement portion 32 relative to the first engagement portion 31.

As described above, the timing belt 14 can be mounted on the belt mount 30 simply by engaging the end portions 14A and 14B of the timing belt 14 with the first engagement portions 31 and the second engagement portions 32. Accordingly, the above-described configuration can facilitate the installation of the open-ended timing belt to the carriage.

For example, when the timing belt 14 is drawn in a direction indicated by any of arrows C1 and C2 illustrated in FIG. 3 for the main scanning of the carriage 5, the engagement between the indented areas 14*a* of the timing belt 14 and the indented areas 31*a* of the first engagement portions 31 and the folding back of the second engagement portions 32 relative to the first engagement portions 31 prevent unintended disengagement of the end portions 14A and 14B from the first engagement portions 31 and the second engagement portions 32, thus allowing the timing belt to be reliably held by the carriage. In addition, as described above, each of the engagement assist portions 34 restricts movement of the timing belt 14 in the direction to move away from the indented areas 31*a* of the first engagement portion 31, thus reliably preventing unintended disengagement.

As described above, in this exemplary embodiment, the inkjet recording apparatus includes the open-ended carriage drawing member having end portions to engage the carriage and extended between the driving pulley and the driven pulley. The carriage has the drawing-member mount with which the end portions of the drawing member are engaged. Each of the end portions of the drawing member has a surface having at least partially an indented area thereon. The drawing-member mount has first engagement portions and second engagement portions. Each of the first engagement portions has at least one indented area to engage the indented area of each of the end portions of the drawing member. Each of the second engagement portions is extended from the corresponding first engagement portion of the first engagement portions and oriented so that the second engagement portion is folded back relative to the corresponding first engagement portion. Each of the end portions of the drawing member is mounted to the drawing-member mount in a state in which the surface having the indented area of each end portion of the drawing member is directed to a fold-back portion of the timing belt folded back at the second engagement portion relative to the corresponding first engagement portion. For such a configuration, by engaging the end portions of the drawing member with the first and second engagement portions of the mount of the carriage, the open-ended drawing member can be firmly and easily assembled with the carriage.

Next, a second exemplary embodiment of the present disclosure is described with reference to FIG. 6.

Figure 6:
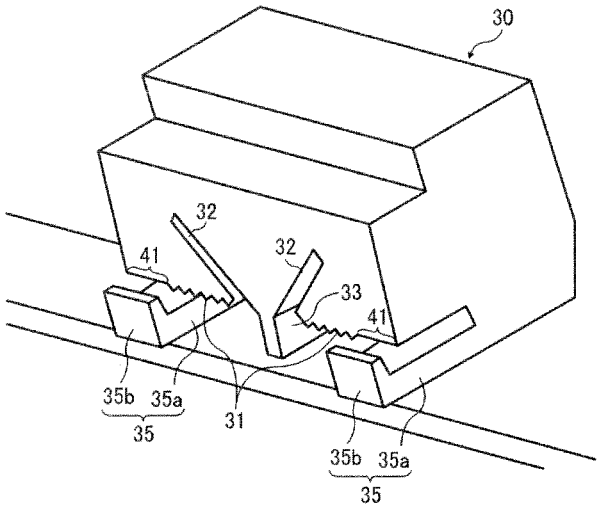
FIG. 6 is a front view of a belt mount of a carriage in a second exemplary embodiment.

FIG. 6 is a front view of a belt mount of a carriage in the second exemplary embodiment.

In this exemplary embodiment, the belt mount 30 has pressure regulators 35 at entry portions 41 of the first engagement portions 31. Each of the pressure regulators 35 has a pressure portion 35*a* to press the timing belt 14 in a direction to engage the indented area 14*a* with the indented area 31*a* of the first engagement portion 31 and a stopper portion 35*b* to restrict movement of the timing belt 14 in a width (short) direction of the timing belt 14 (e.g., the sub-scanning direction in this exemplary embodiment). The pressure regulators 35 are, for example, formed with leaf springs, sheet metals, or molded members.

Alternatively, a single pressure unit may be disposed opposing the indented areas 31*a* of the first engagement portions 31 to urge (press) the timing belt 14.

Such a configuration prevents unintended disengagement of the timing belt 14 from the belt mount 30 and allows the drawing member to be easily and firmly assembled with the carriage.

Next, a third exemplary embodiment of the present disclosure is described with reference to FIG. 7.

Figure 7:
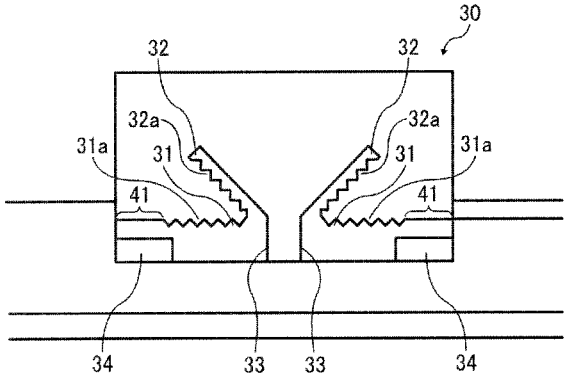
FIG. 7 is a front view of a belt mount of a carriage in a third exemplary embodiment.

FIG. 7 is a front view of a belt mount of a carriage in the third exemplary embodiment.

In this exemplary embodiment, a wall surface of each of the second engagement portions 32 has at least one indented area 32*a* to engage the corresponding indented area 14*a* of the timing belt 14. Such a configuration reliably prevents unintended disengagement of the timing belt 14 from the mount 30 of the carriage 5.

The carriage drawing member is not limited to the timing belt and may be, for example, a wire, a stainless steel (SUS) plate, or any other material in which indentations can be formed.

Next, a fourth exemplary embodiment of the present disclosure is described with reference to FIGS. 8 and 9.

Figure 8:
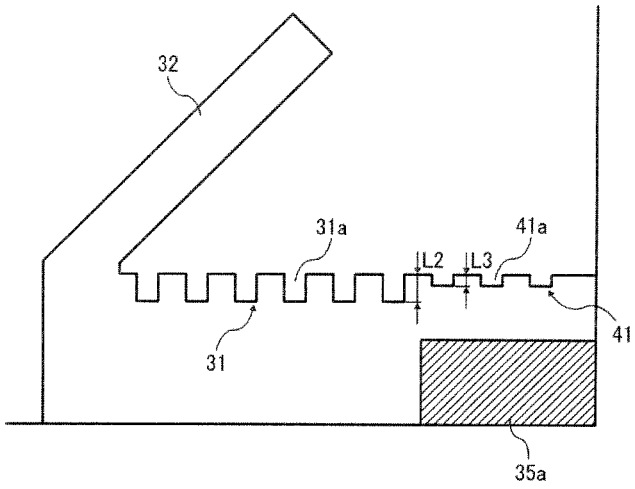
FIG. 8 is an enlarged front view of a belt mount of a carriage in a fourth exemplary embodiment.

FIG. 8 is an enlarged front view of a belt mount of a carriage in the fourth exemplary embodiment. FIG. 9 is an enlarged view of a portion of the belt mount illustrated in FIG. 8.

In this exemplary embodiment, the entry portions 41 of the first engagement portions 35 opposing the pressure portions 35*a* of the pressure regulators 35 have indented areas 41*a* to engage the indented areas 14*a* of the timing belt 14. The indented areas 41*a* engage the indented areas 14*a* of the timing belt 14 to perform the same function as the indented area 31*a*. Thus, the entry portions 41 having the indented area 41*a* serve as third engagement portions.

As illustrated in FIG. 8, the protrusion length (indentation depth) L3 of the indented area 41*a* is set smaller than the protrusion length (indentation depth) L2 of the indented area 31*a*. In addition, the distance between the pressure portion 35*a* and the indented area 41*a* is set smaller than the thickness of the timing belt 14, and the timing belt 14 is pressed and fitted into a space between the pressure portion 35*a* and the indented areas 41*a*. As illustrated in FIG. 9, in a case in which the timing belt 14 is fitted into the space, for example, side slopes of protrusions 14*a*1 of the timing belt 14 to engage the indented areas 41*a* may expand outward due to elastic deformation. Even in such a case, because the protrusion length L3 of the indented areas 41*a* is small in the above-described configuration, the indented area 41*a* can absorb the deformation of the protrusion 14*a*1, thus reliably engaging the indented areas 14*a* of the timing belt 14 with the indented areas 41*a* of the belt mount portion 30 of the carriage 5.

Figure 9:
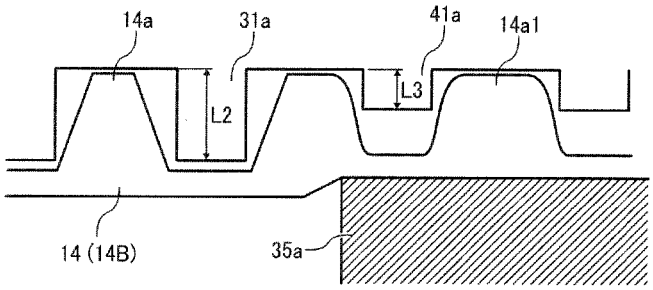
FIG. 9 is a further enlarged front view of the belt mount illustrated in FIG. 8.

Accordingly, when a force is applied to the timing belt 14 in a direction indicated by arrows in FIG. 9, such a configuration reliably prevents unintended disengagement of the timing belt 14.

Figure 11:
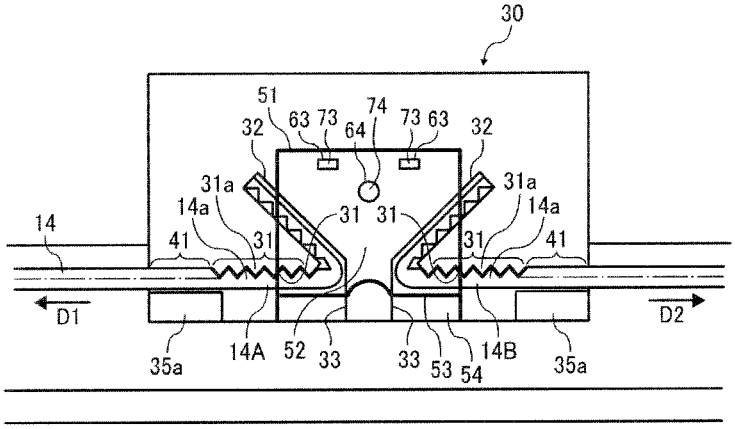
FIG. 11 is a front view of the belt mount of the carriage illustrated in FIG. 10.
Figure 12:
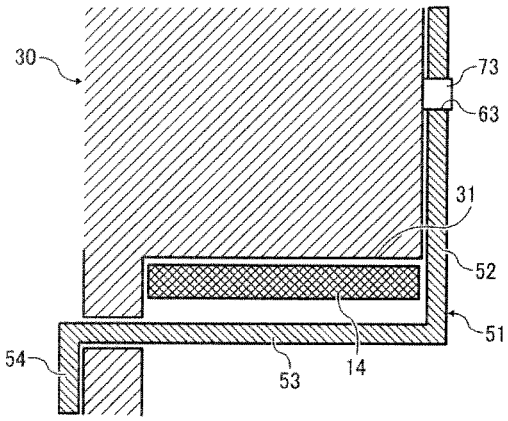
FIG. 12 is a cross-sectional view of the belt mount of the carriage illustrated in FIG. 10.

Next, a fifth exemplary embodiment of the present disclosure is described with reference to FIGS. 10 to 12.

Figure 10:
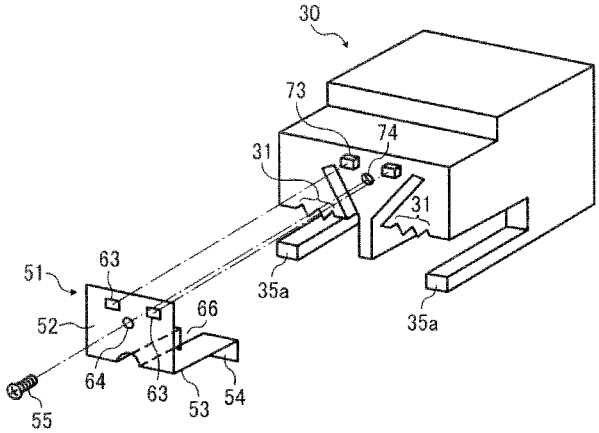
FIG. 10 is a perspective view of a belt mount of a carriage in a fifth exemplary embodiment.

FIG. 10 is a perspective view of a belt mount of a carriage in the third exemplary embodiment. FIG. 11 is a front view of the belt mount illustrated in FIG. 10. FIG. 12 is a cross-sectional view of the belt mount illustrated in FIG. 10. In FIG. 11, a stopper 51 is illustrated in transparent state.

In this exemplary embodiment, instead of the stopper portions 35*b* of the pressure regulators 35 in the above-described second exemplary embodiment, the belt mount 30 has the stopper 51 as a separate member from the pressure portions 35*a*. The stopper 51 is disposed between the end portions 14A and 14B of the timing belt 14 to restrict the movement of the timing belt 14 in the belt width direction.

The stopper 51 has a fixed surface 52 to be fixed on the belt mount 30, intermediate surfaces 53 to sandwich the guide portions 33 of the belt mount portion 30, and engagement surfaces 54 to be inserted along the guide portions 33 for engagement.

The fixed surface 52 has engagement holes 63 to engage projections 73 of the belt mount portion 30 and a fastener hole 64 through which a screw 55 is screwed into a screw hole 74 of the belt mount portion 30 after engagement. As illustrated in FIGS. 11 and 12, the fixed surface 52 covers the timing belt 14 so as to prevent edge portions of the timing belt 14 closer to the cutting edges of the timing belt 14 than the pressure portions 35*a* from moving in the belt width direction.

The stopper 51 has a groove 66 between the intermediate surfaces 53. In a state in which the stopper 51 is mounted to the belt mount portion 30, the intermediate surfaces 53 restrict movement of the timing belt 14 in directions indicated by arrows D1 and D2 of FIG. 11 in conjunction with the groove 66 and the guide portions 33. As illustrated in FIG. 12, the intermediate surfaces 53 opposes a surface of the timing belt 14 in the thickness direction of the timing belt 14, thus restricting movement of the timing belt 14 in the thickness direction.

In this case, the timing belt 14 is fixed with pressure between the first engagement portions 31 and pressure portions 35*a*, and the stopper 51 prevents disengagement of the edge portions of the timing belt 14 closer to the cutting edges of the timing belt 14 than the pressure portions 35*a*.

Next, a sixth exemplary embodiment of the present disclosure is described with reference to FIG. 13.

Figure 13:
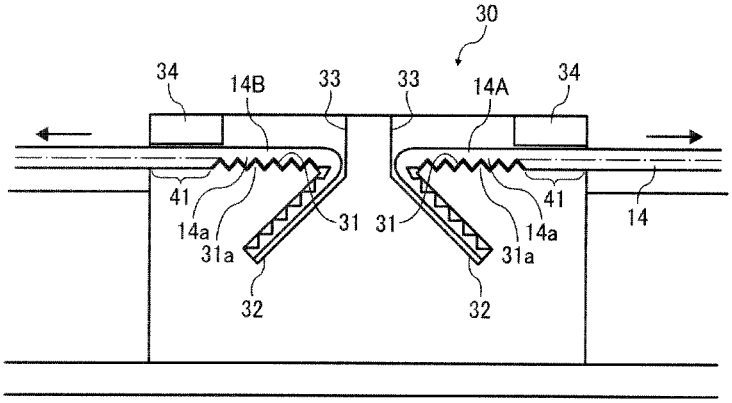
FIG. 13 is a front view of a belt mount of a carriage in a sixth exemplary embodiment in a state in which a timing belt is mounted to the belt mount.

FIG. 13 is a front view of a belt mount of a carriage in the sixth exemplary embodiment in a state in which a timing belt is mounted to the belt mount.

In this exemplary embodiment, the timing belt 14 serving as the drawing member is mounted to an upper portion of the belt mount 30. In this exemplary embodiment, each of the end portions 14A and 14B of the timing belt 14 is mounted to the belt mount 30 in a state in which a surface of each end portion having an indented area 14*a* for engaging a first engagement portion 31 is directed to a fold-back portion of the timing belt 14 that is folded back at a second engagement portion 32 relative to the first engagement portion 31.

The configurations of the above-described exemplary embodiments may be combined.

The above-described configurations of the belt mount portion of the carriage are applicable to, for example, a scanning unit of moving a reading head of an image reading device.

What is claimed is:

1. An image forming apparatus, comprising:

a carriage movably supported to move reciprocally in a main scanning direction;

an image forming unit mounted on the carriage to form an image;

a driving pulley disposed at a first end in the main scanning direction;

a driven pulley disposed at a second end opposite the first end in the main scanning direction;

a driving source operatively connected to the driving pulley to rotate the driving pulley;

an open-ended carriage drawing member extended between the driving pulley and the driven pulley and having end portions mounted to the carriage, each of the end portions having a surface at least partially including an indented area; and a mount disposed on the carriage to mount the end portions of the drawing member and having first engagement portions and second engagement portions, wherein each of the first engagement portions has at least one indented area to engage the indented area of a corresponding one of the end portions of the drawing member, each of the second engagement portions is connected to a corresponding one of the first engagement portions in an orientation to be folded back relative to the corresponding first engagement portion, the end portions of the drawing member are mounted to the mount of the carriage in a state in which the surface of each of the end portions having the indented area to engage a corresponding one of the first engagement portions is directed to a fold-back portion of each of the end portions folded back along a corresponding one of the second engagement portions relative to the corresponding one of the first engagement portions, wherein each second engagement portion amongst the second engagement portions which is connected to a corresponding first engagement portion amongst the first engagement portions forms an acute angle with the corresponding first engagement portion.

2. The image forming apparatus according to claim 1, wherein each of the second engagement portions of the mount has an indented area and each of the end portions of the drawing member has a second indented area to engage the indented area of a corresponding one of the second engagement portions.

3. The image forming apparatus according to claim 1, wherein the mount has a guide portion between the first engagement portions and the second engagement portions to guide the drawing member from the second engagement portions to the first engagement portions.

4. The image forming apparatus according to claim 1, wherein each of the second engagement portions has a groove having a length of an integral multiple of an indentation pitch of the indented area of the drawing member.

5. The image forming apparatus according to claim 1, wherein the carriage has engagement assist portions to restrict movement of the drawing member in a direction in which the drawing member separates from the indented areas of the first engagement portions of the mount.

6. The image forming apparatus according to claim 5, wherein the carriage has stopper portions to restrict movement of the drawing member relative to the first engagement portions in a width direction of the drawing member.

7. The image forming apparatus according to claim 5, further comprising a stopper detachably mounted to the mount of the carriage to restrict movement of the drawing member relative to the first engagement portions and the second engagement portions in a width direction of the drawing member.

8. The image forming apparatus according to claim 7, wherein the stopper further restricts movement of the drawing member in a thickness direction of the drawing member.

9. The image forming apparatus according to claim 5, wherein each of the engagement assist portions has a pressure portion to press the drawing member in a direction to engage the indented area of the end portion of the drawing member with the indented area of the first engagement portion.

10. The image forming apparatus according to claim 9, wherein the mount has third engagement portions opposing the pressure portions to engage the indented areas of the end portions of the drawing member.

11. The image forming apparatus according to claim 10, wherein each of the third engagement portions has a protrusion length smaller than a protrusion length of the indented area of the first engagement portion.

12. The image forming apparatus according to claim 1, wherein each second engagement portion amongst the second engagement portions includes a groove extending longitudinally to receive a length of the corresponding end portion of the open-ended carriage drawing member.

* * * * *